US008356955B2

(12) United States Patent
Nadler

(10) Patent No.: US 8,356,955 B2
(45) Date of Patent: Jan. 22, 2013

(54) SYSTEM AND METHOD FOR CONCRETE SLAB CONNECTION

(75) Inventor: Donald S. Nadler, Blue Springs, MO (US)

(73) Assignee: P.N.A. Construction Technologies, Inc., Atlanta, GA (US)

( * ) Notice: Subject to any disclaimer, the term of this patent is extended or adjusted under 35 U.S.C. 154(b) by 0 days.

(21) Appl. No.: 13/116,851

(22) Filed: May 26, 2011

(65) Prior Publication Data

US 2011/0225908 A1 Sep. 22, 2011

Related U.S. Application Data

(60) Continuation of application No. 12/144,481, filed on Jun. 23, 2008, now abandoned, which is a division of application No. 11/150,403, filed on Jun. 10, 2005, now abandoned.

(60) Provisional application No. 60/578,512, filed on Jun. 10, 2004.

(51) Int. Cl.
*E01C 11/06* (2006.01)

(52) U.S. Cl. ..... 404/73; 404/75

(58) Field of Classification Search ..... 404/50, 404/51, 56, 62, 63, 73, 75
See application file for complete search history.

(56) References Cited

U.S. PATENT DOCUMENTS

| | | | | |
|---|---|---|---|---|
| 3,855,754 | A * | 12/1974 | Scoville et al. | 403/401 |
| 4,733,513 | A | 3/1988 | Schrader | |
| 4,942,912 | A * | 7/1990 | Gakhar et al. | 144/136.95 |
| 5,452,943 | A | 9/1995 | Campbell | |
| 5,458,433 | A * | 10/1995 | Stastny | 403/408.1 |
| 5,487,249 | A * | 1/1996 | Shaw et al. | 52/396.02 |
| 5,730,544 | A * | 3/1998 | Dils et al. | 403/292 |
| 6,021,826 | A * | 2/2000 | Daniell | 144/73 |
| 6,926,463 | B2 * | 8/2005 | Shaw et al. | 404/60 |
| 7,201,535 | B2 | 4/2007 | Kramer | |
| 7,334,962 | B1 | 2/2008 | Shaw | |
| 7,338,230 | B2 * | 3/2008 | Shaw et al. | 404/58 |
| 7,381,008 | B2 * | 6/2008 | Shaw et al. | 404/60 |
| 7,441,985 | B2 * | 10/2008 | Kelly et al. | 404/56 |
| 7,905,680 | B2 | 3/2011 | Albritton | |
| 2005/0036835 | A1 * | 2/2005 | Shaw et al. | 404/51 |
| 2006/0127179 | A1 * | 6/2006 | Nadler | 404/47 |
| 2008/0083130 | A1 | 4/2008 | Boxall | |
| 2009/0060655 | A1 * | 3/2009 | Nadler | 404/52 |

OTHER PUBLICATIONS

American Concrete Institute Committee Report 302.1R-04, "Guide for Concrete Floor and Slab Construction," copyright 2004.

(Continued)

*Primary Examiner* — Gary S Hartmann
(74) *Attorney, Agent, or Firm* — Banner & Witcoff, Ltd.

(57) ABSTRACT

Systems and methods of transferring loads between adjacent cast-in-place slabs, such as concrete slabs, and for accurately positioning dowels between adjacent sections of slabs are provided. A generally planar plate-type dowel is used which may be positioned within a cutaway in a preexisting slab of concrete. The dowel is shaped to generally conform to the shape of the cutaway, which is made by a saw blade. Once the dowel is positioned within the preexisting slab, a new slab is poured adjacent the preexisting slab. Rubber seals are included on the edges of the dowels to provide spacing or a gap between the dowel and the preexisting slab to allow for lateral independent movement of the adjacent slabs, and to prevent concrete from the newly poured second slab from entering into the gap. A saw unit for making a generally planar cut horizontally into an edge of a hardened concrete slab is also provided.

13 Claims, 4 Drawing Sheets

OTHER PUBLICATIONS

Speed Dowel® brochure.
PNA Diamond Dowel® System brochure.
EZform™ brochure.
Greenstreak Speed Plate web page of its introduction in 2007.

* cited by examiner

SYSTEM AND METHOD FOR CONCRETE SLAB CONNECTION

CROSS REFERENCE TO RELATED APPLICATIONS

This application is a continuation application of U.S. patent application Ser. No. 12/144,481 filed Jun. 23, 2008, which is a divisional and which claims priority to Ser. No. 11/150,403, filed Jun. 10, 2005, now abandoned, which claims priority pursuant to 35 U.S.C. 119(e) to co-pending U.S. Provisional Patent Application Ser. No. 60/578,512, filed Jun. 10, 2004, now expired, the entire disclosures of which are incorporated herein by reference.

FIELD OF THE INVENTION

The present inventions relate generally to systems and methods for pavement reinforcement. More particularly, the present inventions are concerned with systems and methods of transferring loads between adjacent cast-in-place slabs, such as concrete slabs, and for accurately positioning dowels between adjacent sections of slabs.

BACKGROUND OF THE INVENTION

In the construction of concrete floors or surfaces (i.e. sidewalks, driveways, roads, etc.), it has long been the practice to make the surface from a series of individual blocks or slabs. Adjacent slabs meet each other at joints which are typically spaced so that each slab has enough strength to overcome internal stresses that would otherwise cause random stress relief cracks.

One problem that can arise when slabs are poured in separate subsections is that the junctions or joints between adjacent sections are subject to damage from downward forces exerted against the slab. To reduce the effects of such forces, it is common practice to embed dowels into the slab. The dowels bridge across the joint between adjacent subsections of the slab and extend a short distance into each subsection. The dowels are placed at regular intervals along the joint, and act to equalize and transfer loads that are exerted against the joint. Various systems have been developed utilizing dowels of a variety of shapes and sizes, including generally planar plate-type dowels, as well as dowels having square, circular or other shaped cross-sections.

If the dowels are not installed correctly, problems can arise. Specifically, if the dowels are not parallel to the slab surface and perpendicular to the joint between the slab sections, unwanted stresses can be created in the slab, which can lead to cracking of the slab. A number of systems and methods have been developed to better ensure proper alignment of the dowels. In some systems dowels, or sheaths for supporting the dowels, are attached to forms prior to pouring of a concrete slab. For example, in U.S. Pat. No. 6,354,760, the disclosure of which is incorporated herein by reference in its entirety, a generally planar plate-type dowel is shown which is supported by a sheath that is embedded within one of two adjacent concrete slabs. The sheath is nailed to an inner surface of a wood form as a first slab is poured. Once the slab has properly hardened, the form is removed and the sheath remains. The dowel is then positioned in the sheath such that half of the dowel protrudes beyond the edge of the slab into a location that will be occupied by the adjacent slab. The adjacent slab is poured and the protruding portion of the dowel is surrounded by the concrete of the second slab.

The generally planar plate-type dowels discussed above provide several advantages over square and round tubular dowels such as increased relative movement between slabs in a direction parallel to the longitudinal axis of the joint; and reduced loadings per square inch close to the joint, while transferring loads between adjacent cast-in-place slabs. Nevertheless, current systems and methods utilizing planar plate-type dowels require that the dowel be installed in new concrete as it is poured. Alternatively, systems and methods have been developed in which a hole is drilled into pre-existing hardened concrete for insertion of a tubular dowel, allowing tubular dowels to be utilized in section repair or other retrofitting applications in which the concrete has been poured and set/hardened prior to placement of dowel (or sheath) within the slab. Notwithstanding, the noted disadvantages of tubular dowels versus planer dowels, drilling in existing concrete is extremely time consuming and creates considerable dust which is undesirable for interior retrofit applications. Therefore, it would be beneficial to provide a system and method for utilizing planar dowels in connection with existing or retrofit concrete applications, and which is easier and less dusty than existing retrofit systems utilizing tubular dowels.

A disadvantage of prior art systems and methods of utilizing planar dowels in new concrete pours in which a sheath is embedded in a slab, is that only wooden forms can be used for forming the slab. This is because the sheath must be nailed to the form before the concrete is poured. Nevertheless, many contractors prefer to utilize reusable metal forms as opposed to wooden forms. Therefore, it would be beneficial to provide a system and method for utilizing planar dowels in slabs that are made with metal forms.

Utilization of the generally planar sheaths of the prior art for positioning dowels within a slab require vibration of the wet concrete to allow the concrete to consolidate around the sheath. When the adjacent slab is poured, the wet concrete for that slab must also be vibrated to allow the concrete to consolidate around the protruding portion of the dowel. Vibration of the wet concrete requires additional labor and special tools that are not necessary in applications in which generally narrow tubular dowels are utilized. Therefore it would be beneficial to provide a system and method for utilizing planar dowels in slabs that reduces the labor required during pouring.

Another disadvantage of prior art systems for locating planar dowels in a slab is that attachment of the sheath to the form requires extremely careful positioning of the sheath with respect to the top edge of the form as well as extremely careful leveling of the form at the location in which the slab edge is to be made. Even slight misalignment of either the sheath or of the form board will result in misalignment of the dowel with the slab and can result in undesired stresses in the slab. Misalignment or dislocation of the sheaths can result after the sheath has been mounted to the form either as the form is being positioned or after the form is in position by workers accidentally stepping on the sheaths or bumping against the sheaths. Misalignment of the form board can also result from workers accidentally kicking the form board, or misalignment can be the result of a warped form board. Therefore, it would be beneficial to provide a system and method for ensuring proper alignment of planar dowels in slabs.

SUMMARY OF THE INVENTION

An object of the instant invention is to provide a system and method for doweling in existing concrete that is faster and cleaner than drilling. Another object of the instant invention is to provide a system and method for positioning planar dowels into existing concrete. Yet another object of the instant invention is to provide a system and method for utilizing planar dowels with metal forms in new concrete applications. Still another object of the instant invention is to provide a system and method for properly aligning planar dowels in a slab. Another object of the instant invention is to provide a system and method for utilizing planar dowels in a slab that minimizes the amount of labor required during new concrete pours.

The objects of the instant invention are accomplished through the use of a generally planer plate-type dowel and a machine, such as a saw, for making a generally planar cut horizontally into an edge of a hardened concrete slab. One end of the dowel is shaped to generally conform to the shape of the cut made by the saw. The size of the dowel is slightly smaller than the size of the cut to allow slight movement generally parallel to the edge of the slab in which the cut is located.

In operation, a first slab of concrete is either a pre-existing slab that is being repaired, or a relatively new slab that has been allowed to set or harden. In the context of a repair application, a generally straight edge to the existing concrete may be made by cutting away a section of the existing slab. In the context of a relatively new slab, a straight edge will be made by a form board that is removed after the concrete has hardened. Once the concrete is hardened and/or a straight edge is obtained, a saw is used to plunge-cut into the edge of the slab at a depth midway between the top surface and the base of the slab. The dowel is then inserted into the cut and the adjacent slab such that half of the dowel is located within the cut in the existing slab and half is protruding from the slab into a location in which an adjacent slab of concrete is to be poured. The adjacent slab is then poured and vibration of the wet concrete of the adjacent slab is used to consolidate the concrete around the protruding portion of the dowel.

Although vibration of the concrete is necessary for the adjacent slab, roughly half the amount of vibration-related labor is utilized in connection with the system and method of the instant invention as is required by systems of the prior art. This is because vibration labor is only utilized on the adjacent slab, as opposed to both slabs as is necessary in the prior art systems. Cutting into an existing, hardened, slab and placement of a dowel in the cut-away, eliminates the need for vibration in the first slab.

In a preferred embodiment of the instant invention the saw is self-guided by a control unit that moves across the top of the slab following the slab edge. The saw can be adjusted to provide a series of spaced-apart cuts along the edge of the slab. In another preferred embodiment, the saw will include a mist system to eliminate dust created as the concrete is cut. Such a system is ideal for interior use of the inventive system.

In a preferred embodiment of the instant invention rubber gaskets, or seal spacers, are connected to the dowel to aid in alignment of the dowel in the cutaway in the slab and to prevent concrete slurry from migrating into the cutaway area in which the dowel is located as the adjacent slab is poured.

The dowel plates utilized in the instant invention can be made in a variety of shapes and sizes depending upon the desired application and the shape of the cut into which the dowel is to be located. The shape can include two generally symmetrical ends, one of which is positioned in the cut-away of the existing slab and the other protruding from the slab to extend into the adjacent slab when it is poured. Alternatively, the shape can be asymmetrical. If an asymmetrical dowel plate is utilized, one end will have a shape generally conforming to the shape of the cut that is made in the existing slab. The shape of the other end will have little significance as the wet concrete will consolidate around the protruding end by vibration of the concrete. The dowel plates utilized in the instant invention can also be utilized in connection with a mounting sheath similar to that used by systems of the prior art, allowing a single dowel to be used both for new construction and retrofit applications.

The system and method of the instant invention provides a means for positioning planar dowels into a retrofit application that is much faster and cleaner than the systems of the prior art. Sawing into a slab of concrete is much faster than drilling. In addition, the use of a wet saw device greatly reduces the amount of dust created during installation. In addition, the system of the instant invention allows the use of any type of forms, whether wood, metal or otherwise, as there is no need to nail sheaths to the forms prior to pouring of the slab. Furthermore, the instant invention eliminates the possibility of misalignment of dowels caused by improper form alignment or by accidental dislocation of dowel mounting sheaths as the slab is poured. This is accomplished by cutting into the slab after the slab has hardened. The angle and position of the cut is gauged by the actual surface of the slab, providing ideal alignment of the dowel with respect to the slab surface.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

Preferred embodiments of the invention, illustrative of the best mode in which the applicant has contemplated applying the principles, are set forth in the following description and are shown in the drawings and are particularly and distinctly pointed out and set forth in the appended claims.

DETAILED DESCRIPTION OF A PREFERRED EMBODIMENT

As required, a detailed embodiment of the present inventions is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
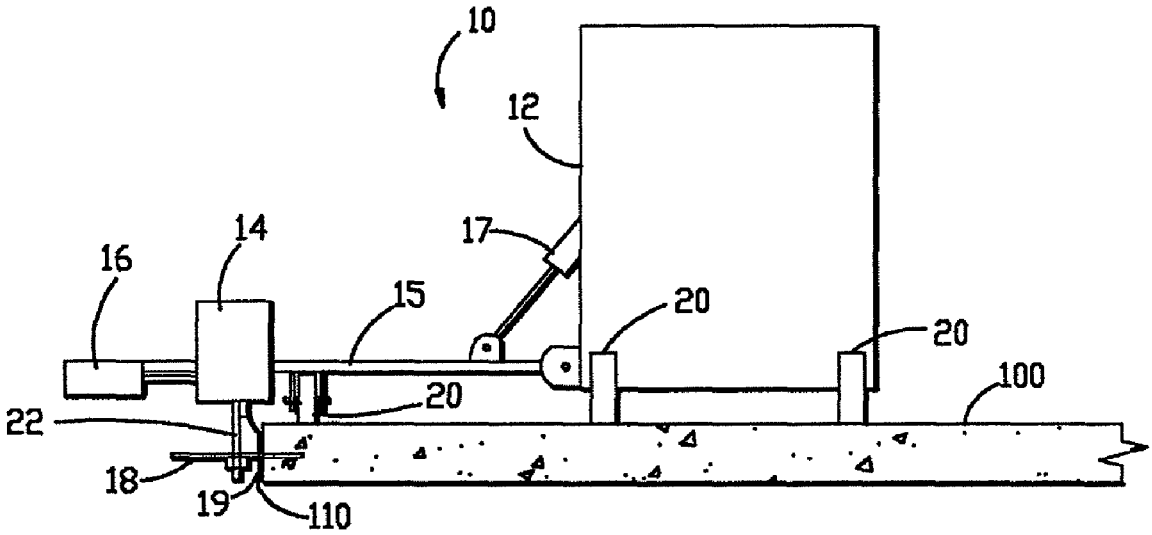
FIG. 1 is an elevation view of a plunge-cut saw unit of the instant invention.
Figure 2:
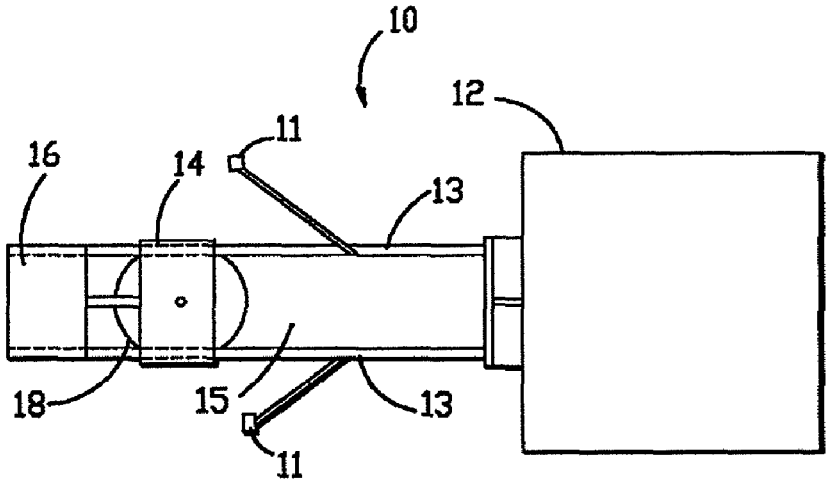
FIG. 2 is a top view of the saw unit shown in FIG. 1.

Referring to FIGS. 1 and 2, a plunge-cut saw unit (10) of the instant invention is shown. As shown in FIG. 1, saw unit 10 travels over the top of preexisting concrete slab 100 on wheels 20 following edge 110 of slab 100. The height of cutting blade 18 is adjustable to control the vertical depth at which the cut is made into slab 100 by raising and lowering mechanism (not shown) which raises and lowers drive unit 14 along with saw blade 18 relative to support arm 15. Alternatively, the height of saw blade 18 may be adjustable by extending and retracting blade drive shaft 22 from blade drive unit 14. Depth stop sensor 19 is included to prevent the vertical depth of the cut from being made too close to the bottom of slab 100. As shown in FIG. 1, depth stop sensor 19 is a member extending downward from drive unit 14. Depth stop sensor 19 will bottom out on the ground if drive unit 14 is positioned too close to the ground, providing a minimum height for the plunge cut by saw blade 18.

Saw blade 18 is plunged horizontally into edge 110 of slab 100 through the extension of engagement cylinder 16 and is retracted from slab 100 by springs (not shown) which are positioned to provide a retracting force on saw blade 18 when engagement cylinder 16 is in the extended position. In a preferred embodiment engagement cylinder 16 comprises a hydraulic piston, however it will be appreciated that alternative engagement mechanisms may be utilized. When pressure is applied to the hydraulic piston, engagement cylinder 16, which is connected to the end of support arm 15, is extended to push drive unit 14 (as well as saw blade 18) inward on support arm 15 towards power unit 12. When pressure is released from the hydraulic piston, the force of the springs will pull drive unit 16 outwards towards the end of support arm 15 away from power unit 12. Drive unit 14 moves horizontally along support arm 15 by riding along slide rails 13.

Power unit 12 includes a drive mechanism or motor to propel saw unit 10 on wheels 20. Power unit 12 also includes control circuitry for saw unit 10 including controls for saw drive unit 14, saw blade 18, engagement cylinder 16, retracting cylinder 17, and any other desired components of saw unit 10. Retracting cylinder 17 connects power unit 12 to support arm 15, such that upon retraction of retracting cylinder 17 support arm 15 is pivotally raised upward to raise saw blade 18 away from the surface of slab 100 for transportation of saw unit 10. Upon extension of retracting cylinder 17 support arm 15 is pivotally lowered toward the surface of slab 100 into the generally parallel orientation shown in FIG. 1.

As is shown in FIG. 2, saw unit 10 includes edge guide sensors 11 extending from support arm 15. Edge guide sensors 11 are designed to maintain contact with edge 110 of slab 100 when saw unit 10 is properly following edge 110. Edge sensors 11 allow saw unit 10 to be programmed to follow edge 110 and create plunge cut at preset intervals along edge 110 so that dowels 30 of the instant invention can be positioned in slab 100.

Figure 8:
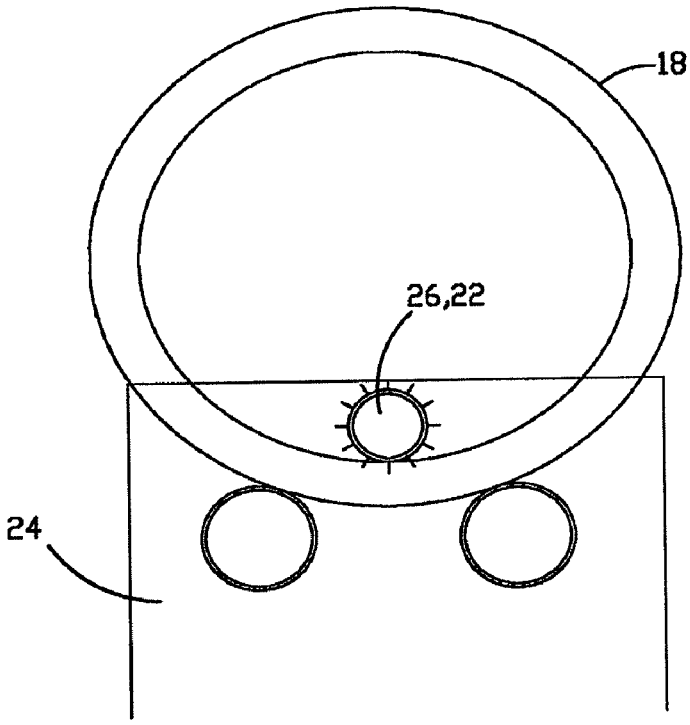
FIG. 8 shows a detailed view of a ring saw of the instant invention.

Referring to FIG. 8, a detailed view of an embodiment of a motor assembly for saw blade 18 is shown. The motor assembly includes saw motor 24 which drives drive motor 26 which in turn rotates saw blade 18. In an embodiment of the instant invention shown in FIGS. 1 and 2, saw motor 24 is located in drive unit 14, and drive shaft 22 functions as the drive motor.

Figure 3:
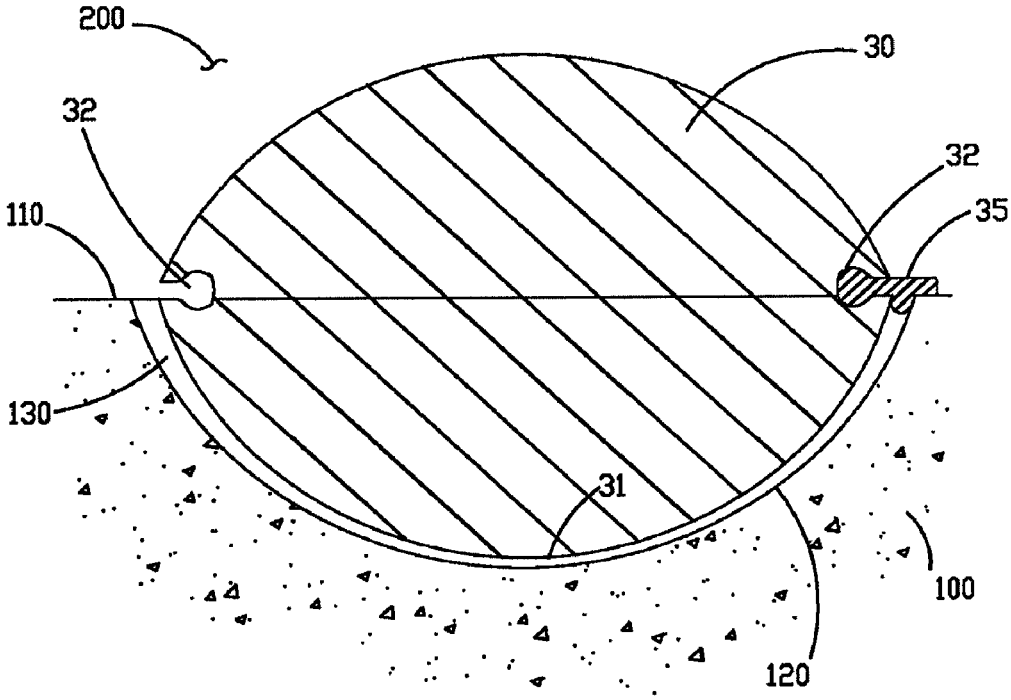
FIG. 3 is a top section view of a planar dowel plate located within a cutaway in an existing concrete slab through the system and method of the instant invention.
Figure 4:
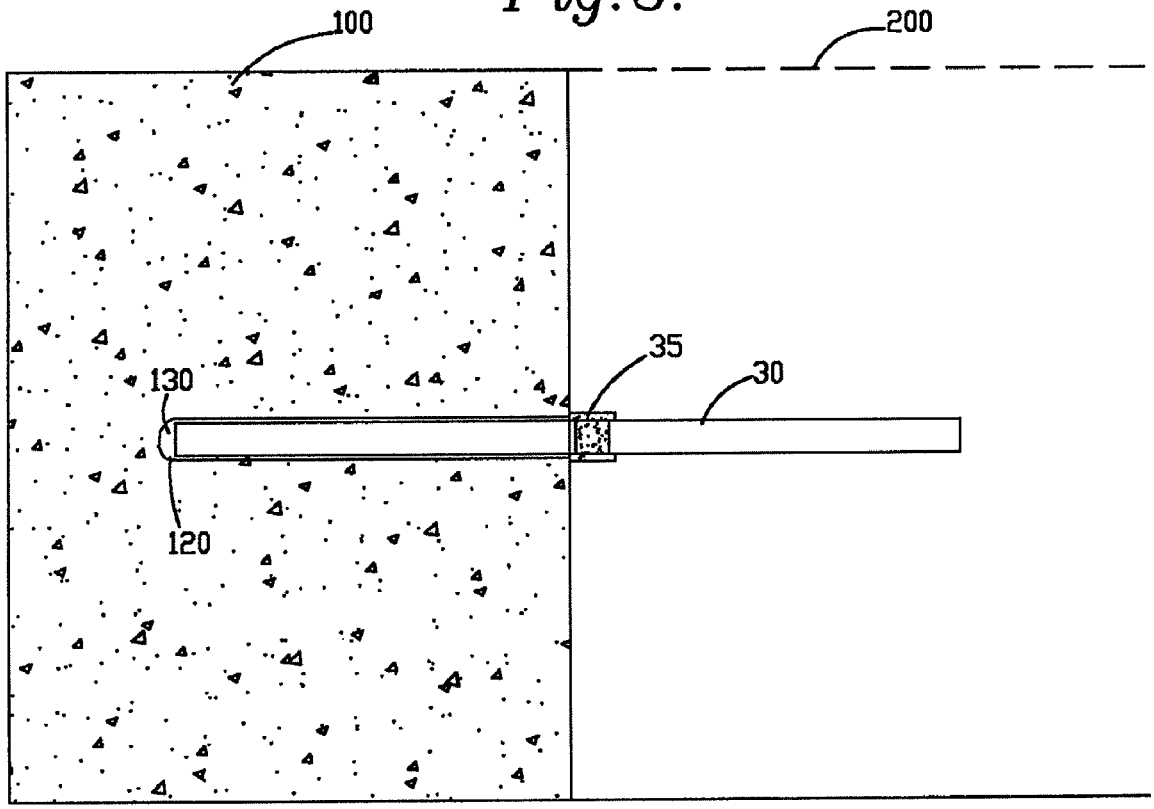
FIG. 4 is a side section view of the planar dowel located within a cutaway in an existing concrete slab shown in FIG. 3.

Referring to FIGS. 3 and 4, one embodiment of an inventive dowel plate (30) as it is used in accordance with the system and method of the instant invention is shown. FIGS. 3 and 4 show an embodiment in which dowel 30 is positioned in a preexisting, hardened slab of concrete, 100, and then a new slab of concrete, 200, is poured adjacent to the existing slab. Cutaway 120 is made in edge 110 of slab 100. Cutaway 120 can be made using saw unit 10 described above, or otherwise made with alternative saw units, such as ring saws of the prior art. Steel dowel 30 shown in FIG. 3 has semi-circular edge which is shaped to conform generally to the shape of cutaway 120. Dowel 30 includes a pair of slots, 32, for receiving and holding rubber centering seals 35 which protrude from dowel 30. Seals 35 function to center dowel 30 within cutaway 120 such that gap 130 is provided between the outer surface of cutaway 120 and edge 31 of dowel 30. Gap 130 allows for lateral independent movement of the two concrete slabs that are being joined together via dowel 30 (including preexisting slab 100, and future slab 200 located directly adjacent slab 100). Once dowel 30 is properly positioned in preexisting slab 100, new slab 200 of concrete is poured and the concrete is subjected to vibration to allow the concrete to consolidate around to portion of dowel 30 located in new slab 200. Seals 35 will prevent concrete from new slab 200 from flowing into gap 130.

Figure 5:
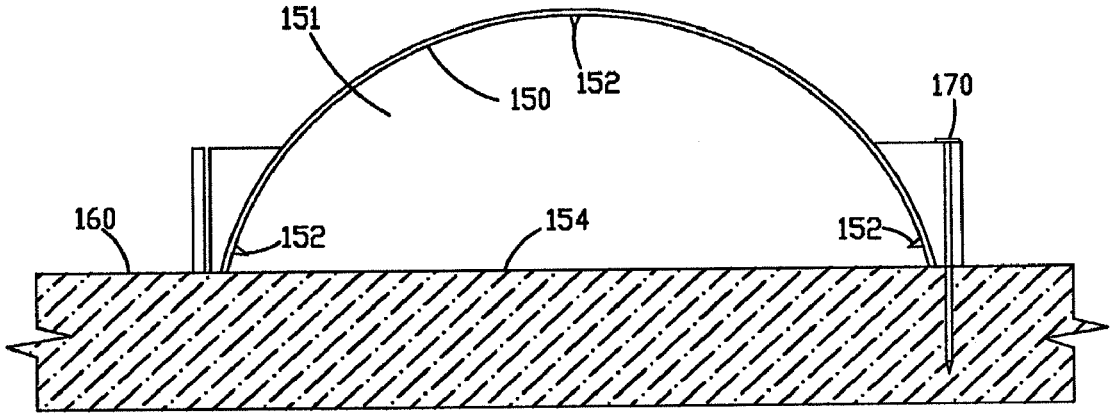
FIG. 5 is a top plan view of a plastic sheath (receiver) for locating a dowel plate of the inventive system into a newly poured slab of concrete as the slab is poured.

Referring to FIG. 5, an embodiment of a sheath/receiver (150) similar to that used by systems of the prior art (such as in U.S. Pat. No. 6,354,760) is shown. Sheath 150 is made of a plastic, or other suitable material and includes inner void 151 for receiving dowel 30. In one embodiment, spacers 152 project from the inner surface of void 151 to create gap 130 between dowel 30 and the slab in which sheath 150 is located. Spacers 152 can be molded into sheath 150, or alternatively can be separate components attached to, or otherwise associated with, sheath 150. Sheath 150 also includes pre-mounted nails 170 which are driven into slab form boards 160 to mount sheath 150 in position prior to pouring of the slab. Once sheath 150 is mounted to form 160 for the slab, the slab is poured. Tape 154 covers the opening of void 151 so that concrete will not flow into void 151 when the slab is poured. The wet concrete is vibrated to allow the concrete to consolidate around sheath 150. Once the concrete has sufficiently hardened, form boards 160 are removed and dowel 30 is inserted into void 151 of receiver/sheath 150, such that half of dowel 30 is located within void 151 (which is surrounded by concrete) and half of dowel 30 extends outward from sheath 150 (not surrounded by concrete). A new slab of concrete is then poured adjacent to the first slab such that the new concrete surrounds the exposed portion of dowel 30 protruding from sheath 150. Spacers 152, which are compressed against dowel 30, will prevent concrete from the second slab from entering void 151. The wet concrete is then vibrated to allow the concrete to consolidate around dowel 30.

Figure 6:
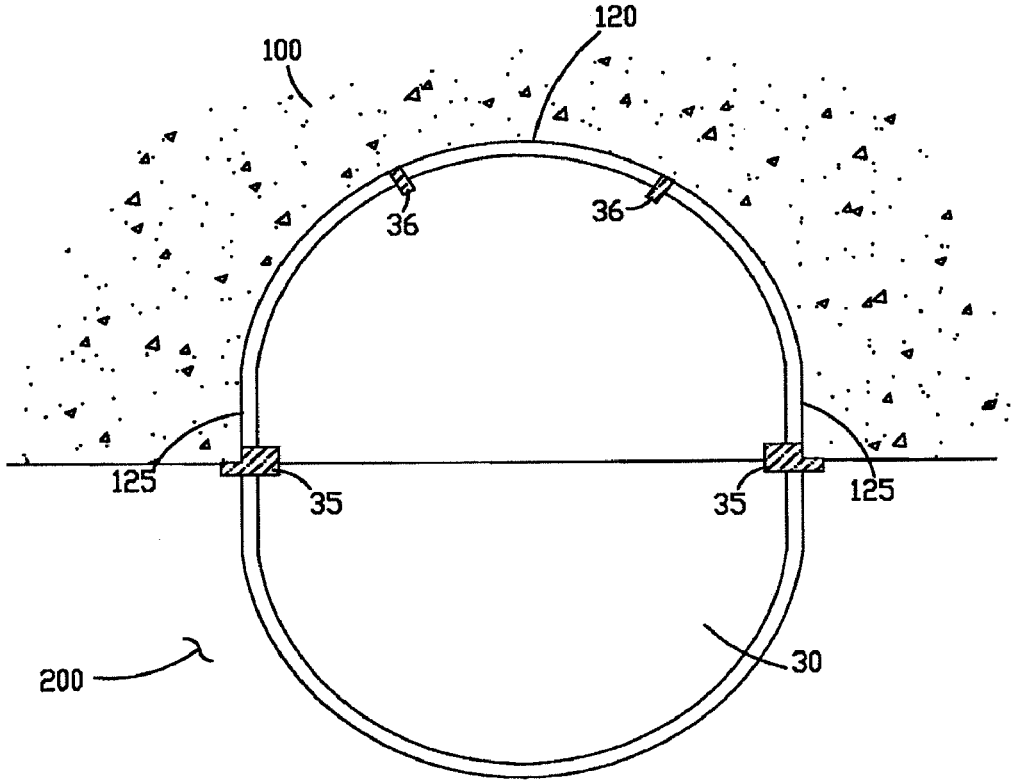
FIG. 6 is top section view of an alternative embodiment of a dowel plate of the system of the instant invention.

FIG. 6 shows an alternative embodiment of dowel 30 having an elongated shape. As is shown in FIG. 6, the elongated shape of dowel 30 allows deeper penetration into slabs 100 and 200 than the embodiment shown in FIGS. 3-5. FIG. 6 shows a situation in which dowel 30 is placed into a preexisting slab of concrete (slab 100); however, dowel 30 of FIG. 6 may also be used in connection with a sheath/receiver in the manner discussed above. When the elongated dowel 30 of FIG. 6 is used in a preexisting slab, a deeper cutaway (120) is necessary than with the generally elliptical dowel of FIGS. 3-5, resulting in generally straight edges 125 of cutaway 120. As is shown in FIG. 6, dowel 30 includes rubber spacers 36 located toward the end of dowel 30 between edge 120 of preexisting slab 100, in addition to centering seals 35. Spacers 36 provide additional support for the elongated dowel of FIG.

6; nevertheless, it will be appreciated that spacers 36 could be used with other dowel shapes, including those shown in FIGS. 3-5.

Figure 7:
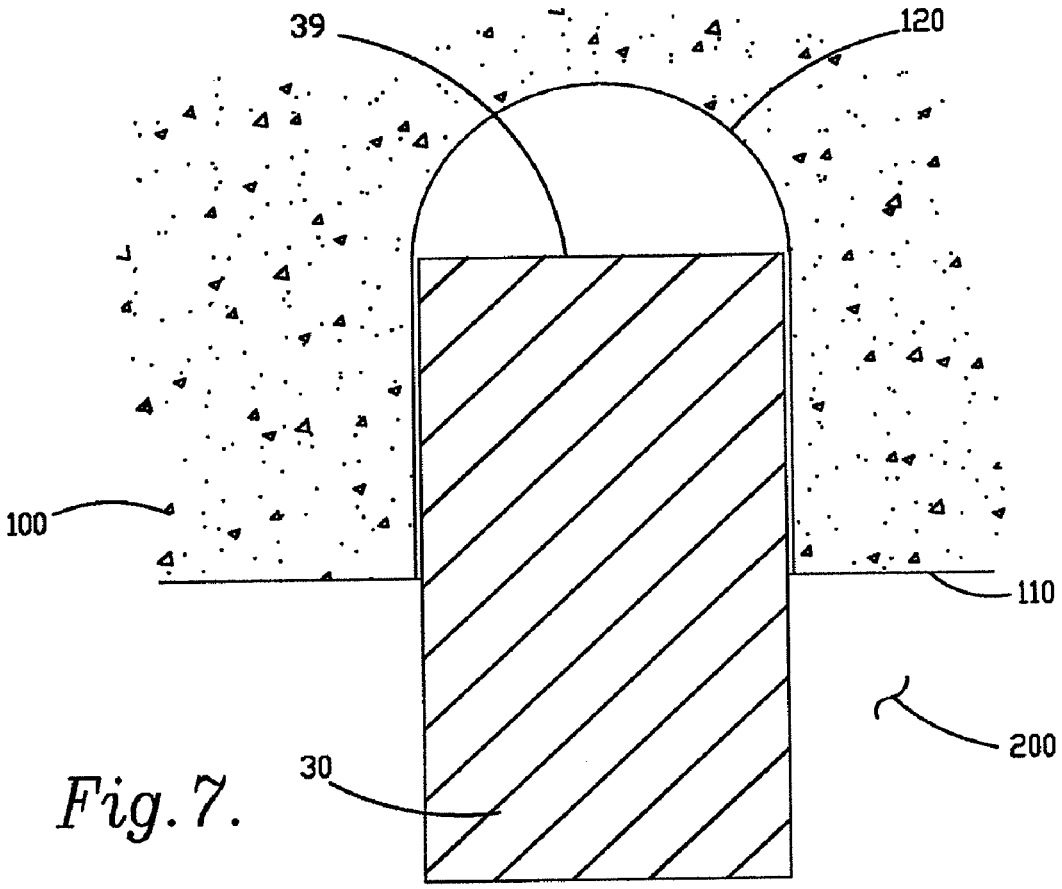
FIG. 7 is a top section view of another alternative embodiment of a dowel plate of the system of the instant invention.

FIG. 7 shows another alternative embodiment of dowel 30 having a generally rectangular elongated shape. Dowel 30 of FIG. 7 can include a generally straight or flat end (39), or alternatively may include a slightly curved end to conform to the shape of the inner surface of cutaway 120 of edge 110 of preexisting slab 100. The end of dowel 30 opposite of end 39 can have a generally straight or flat shape since it will be located in the newly poured slab (200).

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. A method for transferring loads between first and second cast-in-place, substantially horizontal concrete slabs for substantially overcoming stresses in said slabs to avoid stress relief cracks therein, said method comprising the steps of:

a) providing a first hardened and preexisting concrete slab having an exposed substantially upright edge with upper and lower surfaces, b) cutting a substantially transverse slot of a predetermined shape at said edge and into said first concrete slab, said slot being intermediate said upper and lower surfaces of said first concrete slab, c) providing a rigid dowel plate having unitary first and second portions, said first portion of said dowel plate being sized and shaped to be received within said slot, d) inserting said first portion of said dowel plate into said slot, e) projecting said second portion of said rigid dowel plate outwardly from said upright edge of said first concrete slab into the region wherein the second concrete slab is to be poured, f) pouring wet concrete adjacent said first concrete slab into said region where said second concrete slab is poured, g) allowing said wet concrete to harden in place adjacent said first concrete slab, said hardened concrete slabs substantially overcoming internal stresses for avoiding stress relief cracks in said first and second concrete slabs.

2. The method of claim 1 including the steps of providing a substantially horizontal circular saw blade for accomplishing said cutting step, said circular saw blade being adjustable to a desired vertical position relative to said upright edge of said first concrete slab for forming said transverse slot at a predetermined position at said exposed substantially upright edge of said first concrete slab and at a predetermined depth for forming said slot into a predetermined shape within said first concrete slab.

3. The method of claim 1 wherein said dowel plate has said first portion being shaped to substantially conform to said predetermined shape of said slot.

4. The method of claim 1 wherein said rigid dowel plate is made of steel and wherein said second portion of said dowel plate is a mirror image of said first portion of said dowel plate.

5. The method of claim 2 wherein said dowel plate is made of steel and wherein said second portion of said dowel plate is a mirror image of said first portion of said dowel plate.

6. The method of claim 1 including the step of providing a gap between said first portion of said dowel plate and said slot after said first portion of said dowel plate has been inserted into said slot.

7. The method of claim 6 including the step of providing a seal for covering said gap between said first portion of said dowel plate and said upright edge of said first concrete slab.

8. The method of claim 7 wherein said seal between said gap and said first portion of said dowel and said upright edge of said first concrete slab prevents wet concrete from passing into said gap between said first portion of said dowel plate and said slot during said wet concrete pouring step adjacent said first concrete slab.

9. The method of claim 1 including performing steps a), b), c), d) and e) a multiple predetermined number of times while substantially aligning each of said transverse slots at predetermined longitudinally spaced and vertically aligned locations from each other along said upright edge, and said step of pouring wet concrete adjacent said first slab is carried out only after said multiple slots have been provided along said upright edge of said concrete slab.

10. A method of preparing a first concrete slab for receiving multiple planar dowels therein prior to pouring a second concrete slab adjacent to said first concrete slab, said method comprising the steps of:

a) providing a first hardened and preexisting concrete slab having upper and lower surfaces and an exposed substantially upright edge between said upper and lower surface, b) cutting multiple laterally aligned transverse slots of a substantially uniform size and shape into said first concrete slab at a position intermediate said upper and lower surfaces in predetermined longitudinally aligned intervals along said upright edge, c) providing multiple planar dowels each with first and second portions, said first portions of each of said dowels being sized and shaped to be received within each of said slots, d) inserting said first portions of said planar dowels into said longitudinally aligned slots, and e) projecting said second portions of said planar dowels laterally outwardly from said upright edge of said first concrete slab and into the region where said second concrete slab is to be poured.

11. The method of claim 10 including the step of providing a substantially horizontal circular saw blade for accomplishing said cutting step, said circular saw blade being adjustable to a desired vertical position relative to said upright edge of said first concrete slab for forming said multiple slots at said exposed substantially upright edge, at a predetermined horizontal depth for said slots and at a predetermined shape within said first concrete slab.

12. The method of claim 10 wherein said planar dowels have said first portions shaped to substantially conform to the predetermined shape of said slots.

13. The method of claim 10 wherein said planar dowels are made of steel and wherein said second portions of said planar dowels are a mirror image of said first portions of said dowels.

* * * * *